US011767759B2

(12) United States Patent
Huang et al.

(10) Patent No.: US 11,767,759 B2
(45) Date of Patent: Sep. 26, 2023

(54) PISTONLESS ROTARY MOTOR FOR AIR COMPRESSOR

(71) Applicants: Hung-Chih Huang, Taichung (TW); Huang-Ming Liu, Tainan (TW)

(72) Inventors: Hung-Chih Huang, Taichung (TW); Huang-Ming Liu, Tainan (TW)

( * ) Notice: Subject to any disclaimer, the term of this patent is extended or adjusted under 35 U.S.C. 154(b) by 0 days.

(21) Appl. No.: 17/664,430

(22) Filed: May 23, 2022

(65) Prior Publication Data

US 2022/0282622 A1 Sep. 8, 2022

(51) Int. Cl.

| | |
|---|---|
| ***F01C 1/22*** | (2006.01) |
| ***F01C 21/00*** | (2006.01) |
| ***F04C 15/06*** | (2006.01) |
| ***F01C 21/18*** | (2006.01) |

(52) U.S. Cl.

CPC ..... *F01C 1/22* (2013.01); *F01C 21/003* (2013.01); *F01C 21/18* (2013.01); *F04C 15/06* (2013.01)

(58) Field of Classification Search

CPC ..... F01C 1/22; F01C 21/003; F01C 21/18; F04C 15/06

See application file for complete search history.

(56) References Cited

U.S. PATENT DOCUMENTS

| | | | | |
|---|---|---|---|---|
| 3,452,643 A * | 7/1969 | Pratt | F01C 1/22 | 418/113 |
| 4,297,090 A * | 10/1981 | Hoffmann | F01C 1/22 | 418/94 |
| 6,575,719 B2 * | 6/2003 | Manner | F01C 1/22 | 418/123 |
| 8,978,618 B2 * | 3/2015 | Davis | F01C 1/22 | 60/519 |

* cited by examiner

*Primary Examiner* — Mary Davis

(57) ABSTRACT

A pistonless rotary motor for air compressor includes a triangular rotor rotatably disposed in a rotor cavity of a housing. The housing further includes two opposite, radially spaced first grooves in the peripheral wall and two opposite, radially spaced second grooves in the peripheral wall. The first groove is proximate the intake and the second groove is proximate the exhaust. The first grooves are disposed at a top dead center of the rotor relative to the rotor cavity and configured to release air having a first pressure when the rotor revolves eccentrically. The second grooves are disposed the top dead center of the rotor relative to the rotor cavity when the rotor revolves eccentrically and configured to release air having a second pressure which is less than the first pressure.

2 Claims, 5 Drawing Sheets

PISTONLESS ROTARY MOTOR FOR AIR COMPRESSOR

FIELD OF THE INVENTION

The invention relates to air compressors and more particularly to a pistonless rotary motor for air compressor, the pistonless rotary motor having grooves for flowing pressurized air to a compression stroke of a next compression chamber to that pressure of the incoming air can be increased.

BACKGROUND OF THE INVENTION

The Wankel engine is a type of internal combustion engine using an eccentric rotary design to convert pressure into rotating motion. Compared to the reciprocating piston engine, the Wankel engine has more uniform torque, less vibration, and is more compact and weighs less. Wankel engines deliver three power pulses per revolution of the rotor. The output shaft uses toothed gearing to turn three times faster giving one power pulse per revolution. In one revolution, the rotor experiences power pulses and exhausts gas simultaneously. For comparison, in a two-stroke piston engine there is one power pulse for each crankshaft revolution and, in a four-stroke piston engine, one power pulse for every two revolutions.

In a typical pistonless rotary motor for air compressor, at a compression stroke when the rotor reaches a top dead center, exhausts are closed and volume of a compression chamber is decreased to a minimum. Air resistance of a next intake stroke can be increased greatly if there is no means to release the remained pressurized air. As a result, performance of the air compressor is significantly decreased. Thus, the need for improvement still exists.

SUMMARY OF THE INVENTION

It is therefore one object of the invention to provide a pistonless rotary motor comprising a housing including two axially spaced end walls, a peripheral wall extending between the end walls together with the end walls to form a rotor cavity, two opposite, radially spaced intakes, and two opposite radially spaced exhausts; and a triangular rotor rotatably disposed in the rotor cavity and including three peripheral faces with an apex portion formed between any two adjacent peripheral faces, the apex portions being in sealing engagement with an inner surface of the peripheral wall to form three moving compression chambers in the rotor cavity, volumes of the compression chambers being configured to change as the rotor rotates eccentrically; wherein the housing further comprises two opposite, radially spaced first grooves in the peripheral wall and two opposite, radially spaced second grooves in the peripheral wall; wherein the first groove is proximate the intake and the second groove is proximate the exhaust; wherein the first grooves are disposed at a top dead center of the rotor relative to the rotor cavity and configured to release air having a first pressure when the rotor revolves eccentrically; and wherein the second grooves are disposed the top dead center of the rotor relative to the rotor cavity when the rotor revolves eccentrically and configured to release air having a second pressure.

Preferably, the first pressure is greater than the second pressure.

The above and other objects, features and advantages of the invention will become apparent from the following detailed description taken with the accompanying drawings.

DETAILED DESCRIPTION OF THE INVENTION

Figure 1:
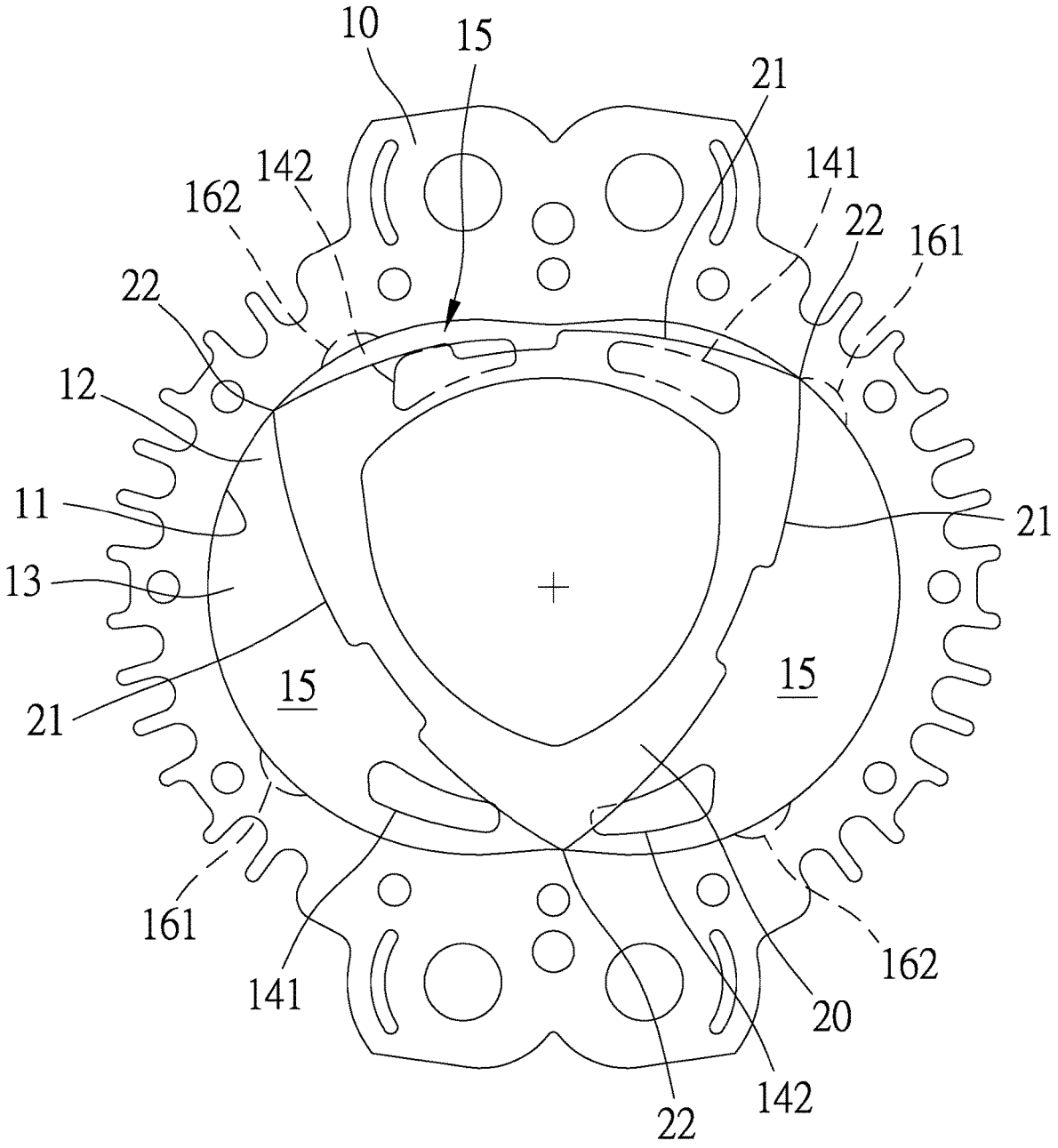
FIG. 1 schematically depicts a pistonless rotary motor for air compressor of the invention.
Figure 2:
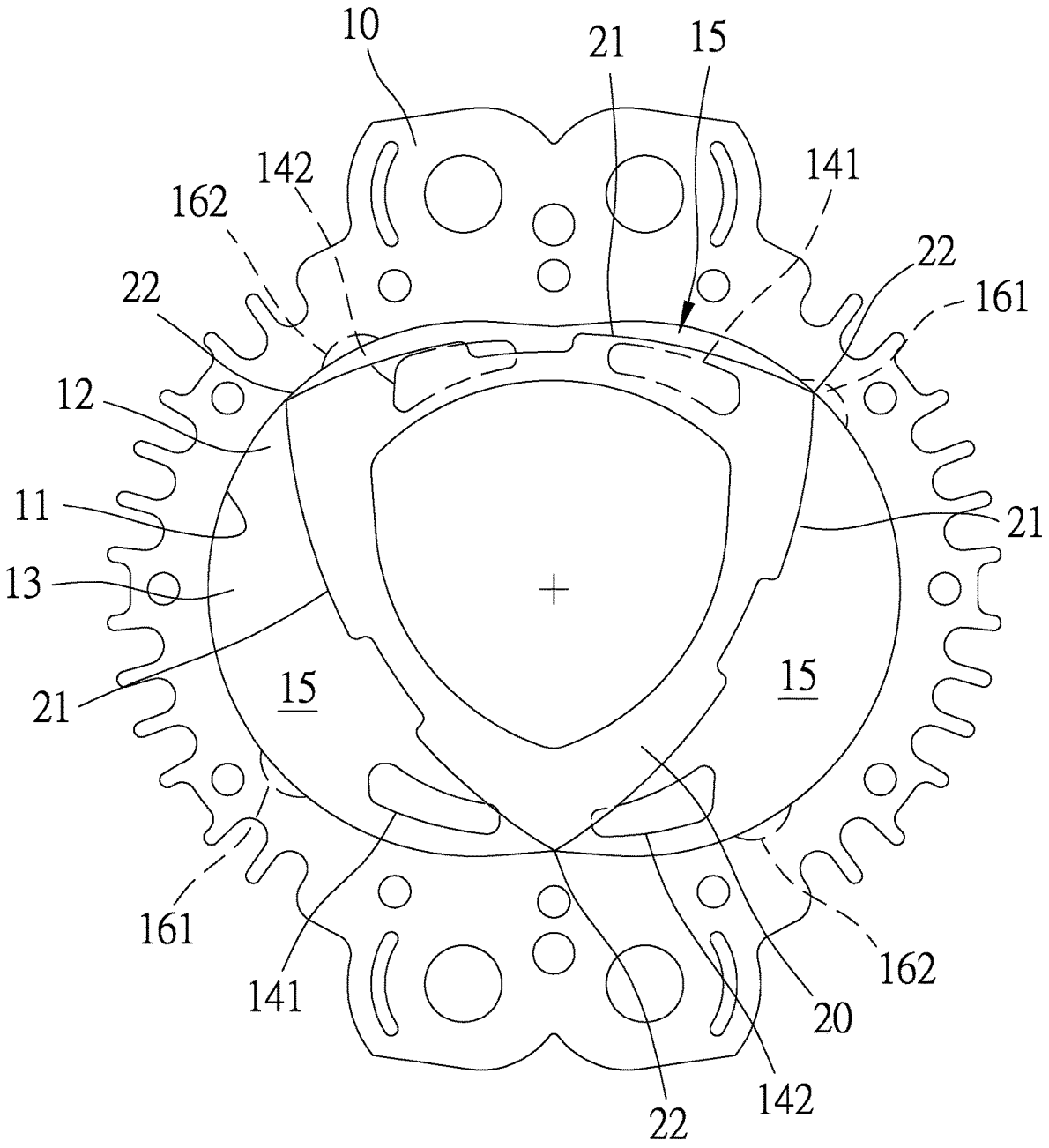
FIG. 2 is a view similar to FIG. 1 showing remained pressurized air beginning to flow to a next compression stroke.
Figure 3:
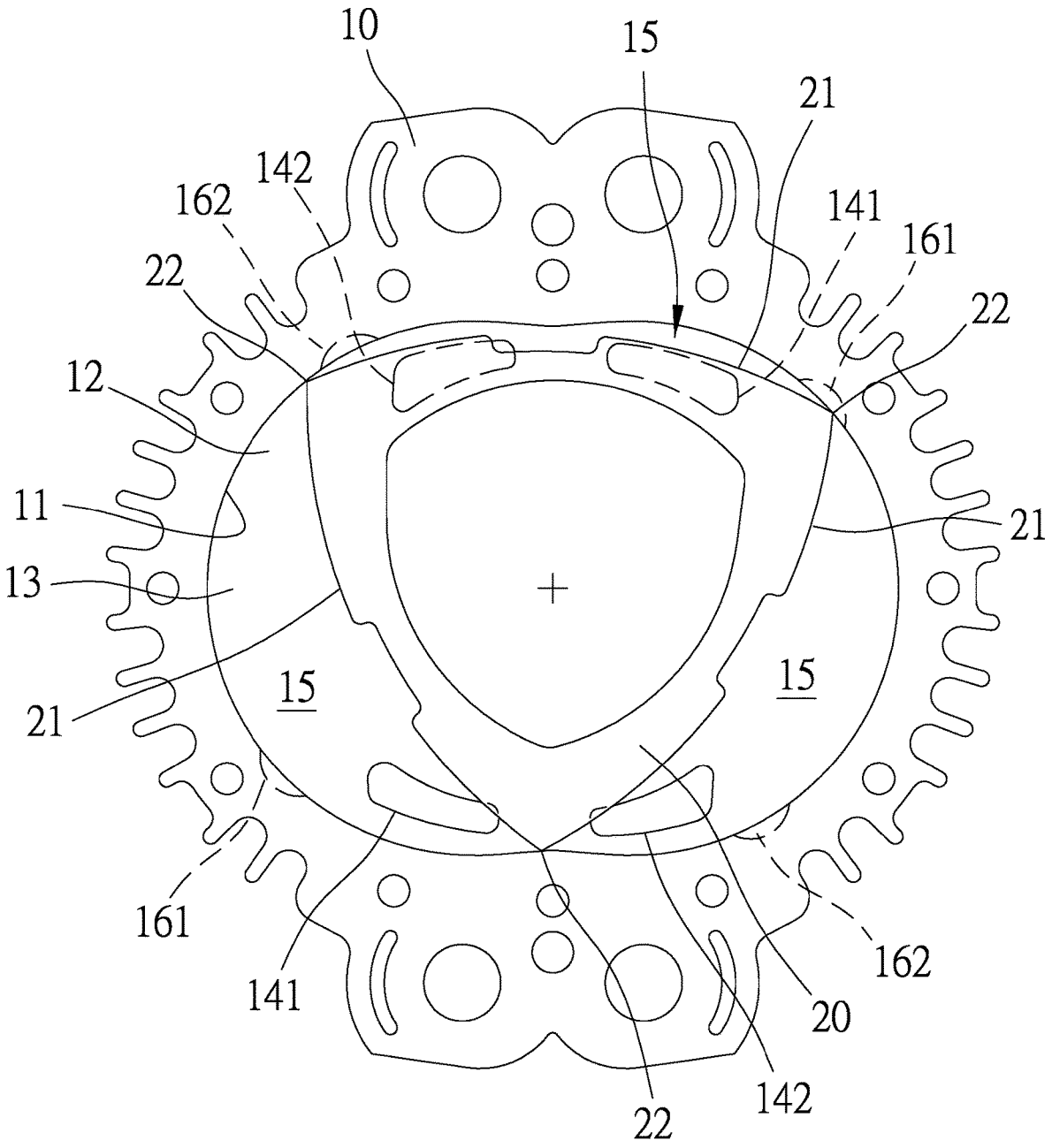
FIG. 3 is a view similar to FIG. 2 showing remained pressurized air during the flowing.

Referring to FIGS. 1 to 5, a pistonless rotary motor for air compressor in accordance with the invention comprises a housing 10 including two axially spaced end walls 12, a peripheral wall 11 extending between the end walls 12 together with the end walls 12 to form a rotor cavity 13, two opposite, radially spaced intakes 141, and two opposite radially spaced exhausts 142; and a triangular rotor 20 rotatably disposed in the rotor cavity 13 and including three peripheral faces 21 with an apex portion 22 formed between any two adjacent peripheral faces 21, the apex portions 22 being in sealing engagement with an inner surface of the peripheral wall 11 to form three moving compression chambers 15 in the rotor cavity 13. Volumes of the compression chambers 15 change as the rotor 20 rotates eccentrically.

Characteristics of the invention are detailed below. Two opposite, radially spaced first grooves 161 and two opposite, radially spaced second grooves 162 are provided in the peripheral wall 11. The first groove 161 is proximate the intake 141 and the second groove 162 is proximate the exhaust 142. Specifically, the first grooves 161 are provided at a top dead center of the rotor 20 relative to the rotor cavity 13 and configured to release pressurized air. The second grooves 162 are provided at the top dead center of the rotor 20 relative to the rotor cavity 13 and configured to release exhaust.

In a revolving operation of the rotor 20, air flows into the compression chambers 15 via the intakes 141. At a first stage of an exhaust stroke, the first grooves 161 are open and pressurized air remained in the first grooves 161 flows to a compression stroke of a next compression chamber 15 for increasing pressure of the incoming air (see FIGS. 2 and 3).

Figure 4:
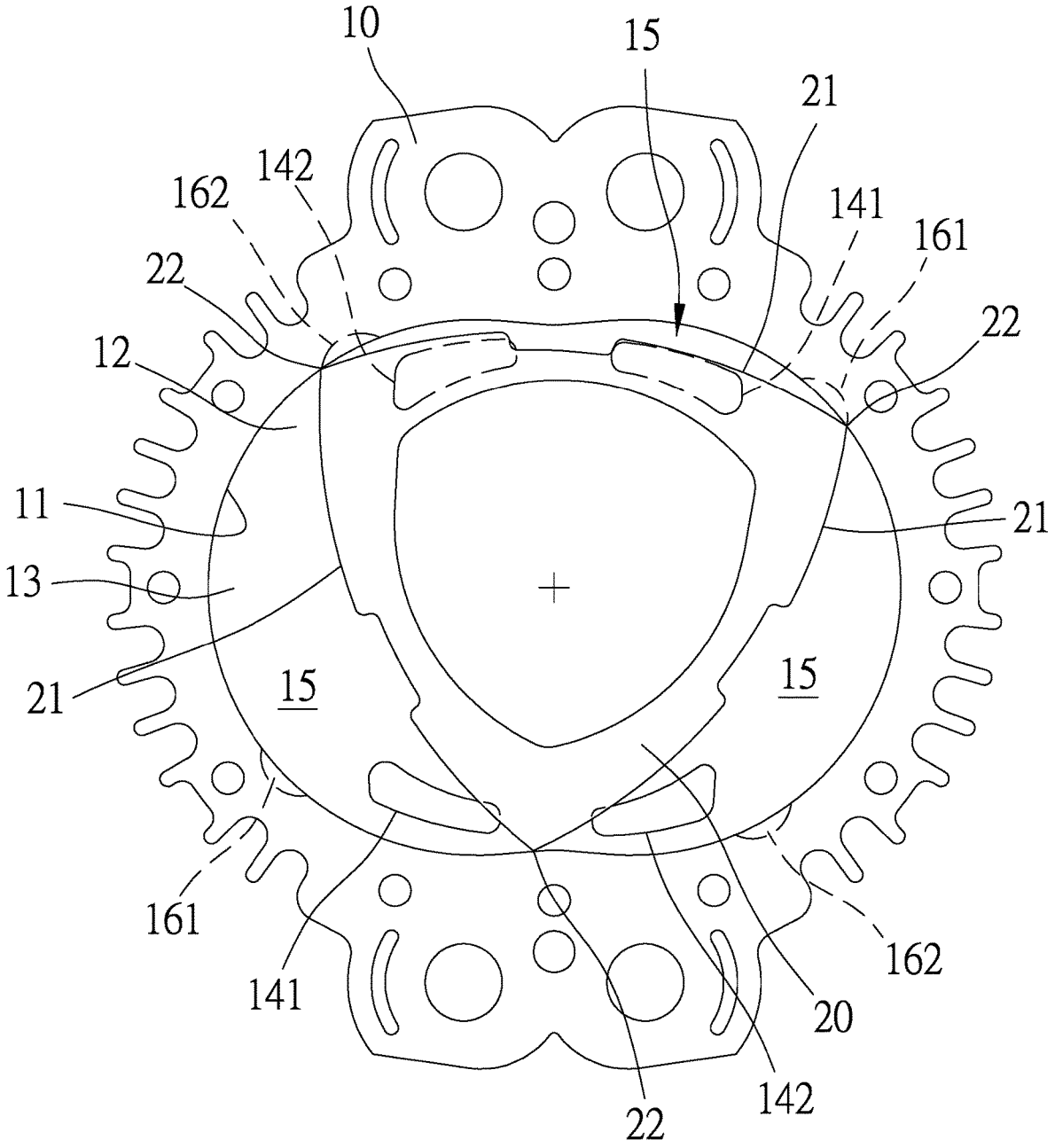
FIG. 4 is a view similar to FIG. 3 showing remained pressurized air at the end of the flowing.
Figure 5:
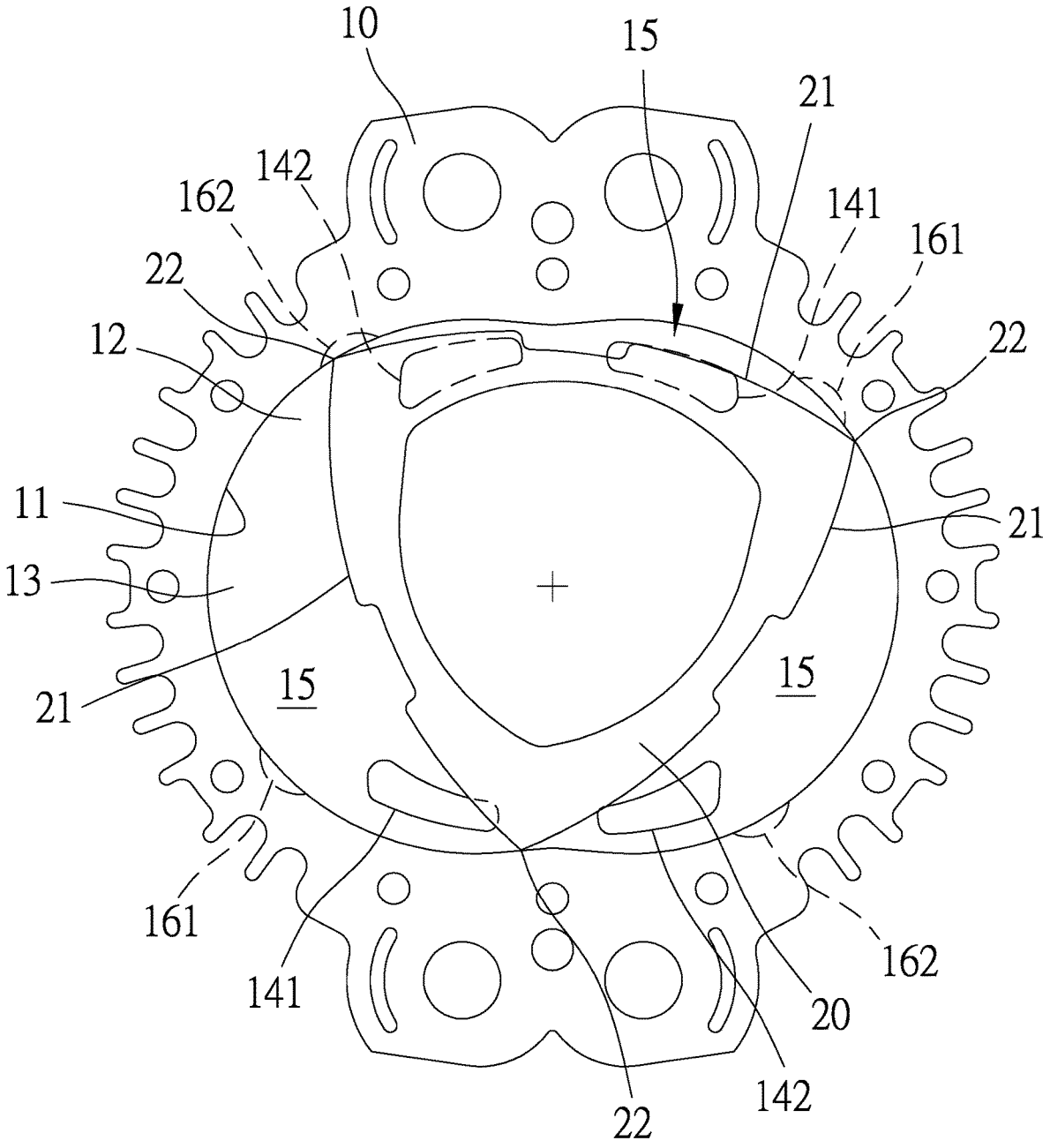
FIG. 5 is a view similar to FIG. 4 showing remained pressurized air during the end of the flowing.

At a second stage of the exhaust stroke, the first grooves 161 are closed and air remained in the second grooves 162 flows to an intake stroke of a previous compression chamber 15 for release (see FIGS. 4 and 5).

It is envisaged by the invention that exhaust is prevented from being disadvantageously pressurized in the exhaust stroke to decrease compression performance.

While the invention has been described in terms of preferred embodiments, those skilled in the art will recognize that the invention can be practiced with modifications within the spirit and scope of the appended claims.

What is claimed is:

1. A pistonless rotary motor, comprising:

a housing including two axially spaced end walls, a peripheral wall extending between the end walls together with the end walls to form a rotor cavity, two opposite, radially spaced intakes, and two opposite radially spaced exhausts; and a triangular rotor rotatably disposed in the rotor cavity and including three peripheral faces with an apex portion formed between any two adjacent peripheral faces, the apex portions being in sealing engagement with an inner surface of the peripheral wall to form three moving compression chambers in the rotor cavity, volumes of the compression chambers being configured to change as the rotor rotates eccentrically;

wherein the housing further comprises two opposite, radially spaced first grooves in the peripheral wall and two opposite, radially spaced second grooves in the peripheral wall; wherein the first groove is proximate the intake and the second groove is proximate the exhaust; wherein the first grooves are disposed at a top dead center of the rotor relative to the rotor cavity and configured to release air having a first pressure when the rotor revolves eccentrically; and wherein the second grooves are disposed the top dead center of the rotor relative to the rotor cavity when the rotor revolves eccentrically and configured to release air having a second pressure.

2. The pistonless rotary motor of claim 1, wherein the first pressure is greater than the second pressure.

* * * * *